US009630240B2

(12) United States Patent
Murata et al.

(10) Patent No.: US 9,630,240 B2
(45) Date of Patent: Apr. 25, 2017

(54) FORGED MATERIAL SIZING METHOD AND APPARATUS

(71) Applicant: Musashi Seimitsu Industry Co., Ltd., Toyohashi-shi, Aichi (JP)

(72) Inventors: Shinichi Murata, Toyohashi (JP); Yasuyoshi Matsui, Toyohashi (JP); Shinji Ieki, Toyohashi (JP)

(73) Assignee: MUSASHI SEIMITSU INDUSTRY CO., LTD., Toyohashi-Shi (JP)

( * ) Notice: Subject to any disclaimer, the term of this patent is extended or adjusted under 35 U.S.C. 154(b) by 79 days.

(21) Appl. No.: 14/679,629

(22) Filed: Apr. 6, 2015

(65) Prior Publication Data

US 2015/0283599 A1 Oct. 8, 2015

(30) Foreign Application Priority Data

Apr. 7, 2014 (JP) ..... 2014-078686

(51) Int. Cl.
*B21K 1/30* (2006.01)
*B21J 5/02* (2006.01)
*B21J 13/02* (2006.01)

(52) U.S. Cl.
CPC ..... *B21K 1/30* (2013.01); *B21J 5/025* (2013.01); *B21J 13/02* (2013.01); *Y10T 29/49474* (2015.01)

(58) Field of Classification Search
CPC ..... B21J 5/02; B21J 5/025; B21J 5/10; B21J 5/12; B21K 1/30; B21K 1/305; B21D 53/28
USPC ..... 29/893.34, 893, 893.3, 893.33, 893.35; 72/355.2–355.6, 352, 353.2, 354.6
See application file for complete search history.

(56) References Cited

U.S. PATENT DOCUMENTS 5,867,901 A * 2/1999 Noda ..... B21K 1/30 29/893.3
6,250,128 B1 * 6/2001 Ando ..... B21J 5/02 72/20.2
7,000,444 B2 * 2/2006 Roeske ..... B21J 13/08 29/893.34
9,091,338 B2 * 7/2015 O-Oka ..... F16H 55/08

FOREIGN PATENT DOCUMENTS

JP 09-010883 1/1997
JP 4139277 B2 * 8/2008

OTHER PUBLICATIONS

Original PDF and machine translation from ProQuest dialog of JP4139277B2 to Ishida are attached.*

* cited by examiner

*Primary Examiner* — Peter DungBa Vo
*Assistant Examiner* — John S Lowe
(74) *Attorney, Agent, or Firm* — Rankin, Hill & Clark LLP

(57) ABSTRACT

An upper die and a lower die are brought together to perform a sizing work on a roughly forged part of a primary forged article within a die cavity defined between the upper and lower dies. The lower die has a vertical through-hole directly communicated with the die cavity, and a punch is relatively movably received in the vertical through-hole in such a manner as to define jointly with the vertical through-hole an annular material flow passage. During the sizing process, a material of the roughly forge part is forced against a peripheral surface of the die cavity and excess material is allowed to flow into the annular material flow passage.

7 Claims, 4 Drawing Sheets

FORGED MATERIAL SIZING METHOD AND APPARATUS

FIELD OF THE INVENTION

The present invention relates to a sizing method and a sizing apparatus that perform a sizing process on a roughly forged part of a primary forged article to thereby produce a secondary forged article with a sized part of desired dimensional accuracy.

BACKGROUND OF THE INVENTION

Sizing is a metal finishing process that can be used for finishing a forged article requiring good dimensional accuracy, such as a gear and the like. The sizing is generally performed within a closed die, as shown, for example, in Japanese Patent Application Laid-open Publication (JP-A) No. 09-010883.

In the sizing process shown in JP 09-010883A, a helical gear member as a primary forged article is constrained on its circumference by a helical gear die having internal sizing helical gear teeth and held in a floating state, and while keeping this condition, the helical gear member is press-formed from above and below by upper and lower punches each having helical gear teeth same as those of a finished helical gear and axially movably engageable with the internal sizing helical gear teeth of the helical gear die. The helical gear member as the primary forged article can thus be sized into a helical gear having sized gear teeth of desired dimensional accuracy.

Quality of the sizing gives a great influence upon the service life of gears. In view of an increased demand for a long-life, high-accuracy gear or the like mechanical component, it is highly desirable to provide a sizing technique which is capable of finishing gear teeth to ensure better dimensional accuracy and surface finish.

It is accordingly an object of the present invention to provide a sizing method and a sizing apparatus which are capable of finishing a roughly forged part of a mechanical component with better dimensional accuracy and surface finish.

SUMMARY OF THE INVENTION

The present inventors have found through experiments that adjustment of the forging pressure, for example, is not fully effective to increase the surface roughness of a sized surface to a desired level. After reconsideration of an experiment apparatus, an attempt has been made to produce a material flow (branch flow) oriented in a direction which is different from a direction toward the inner surface of a sizing die. The branch flow has an effect to promote the material flow tending to urge the material to swell more positively toward the inner surface of the sizing die, leading to a remarkable improvement in the surface roughness as compared to the surface roughness obtained by the conventional sizing process performed within a closed sizing die. The present invention has been completed based on the foregoing finding and may be summarized as follows.

According to a first aspect of the present invention, there is provided a method of sizing a roughly forged part of a primary forged article to produce a secondary forged article having a sized part of desired dimensional accuracy, the method comprising the steps of: providing an upper die and a lower die relatively movable toward and away from each other and jointly defining a die cavity complementary in shape to the sized part of the secondary forged article to be produced, and a punch relatively movably received in a vertical through-hole formed in one of the upper die and the lower die in direct communication with the die cavity such that an annular material flow passage is defined between the vertical through-hole and the punch; setting the roughly forged part of the primary forged article in the die cavity while the upper and lower dies are opened; and bringing together the upper die and the lower die to thereby perform a sizing work on the roughly forged part of the primary forged article within the die cavity and, while keeping a closed state of the upper and lower dies, moving the upper and lower dies and the punch relatively to each other in a vertical direction to advance the punch toward the die cavity to thereby force a material of the roughly forged part against a peripheral surface of the die cavity while allowing an excess material of the roughly forged part to flow into the annular material flow passage, thereby producing a secondary forged article.

As the punch advances toward the die cavity, the material of the roughly forged part being sized within the die cavity is forced against the peripheral surface of the die cavity and excess material generated during the sizing process is allowed to flow into the annular material flow passage. This is due to the effect of two material flows created during the sizing process: a first material flow is directed toward the peripheral surface of the die cavity, and a second material flow is directed toward the material flow passage. Thus created branched material flows have an effect to urge the material to swell more positively toward the peripheral surface of the die cavity. As a consequence, the roughly forged part is finished into a sized part with better dimensional accuracy and surface finish.

In one preferred form of the invention, the primary forged article is a gear having roughly forged gear teeth and a shaft extending from a center of the gear, the shaft being received in the vertical through-hole of said one of the upper die and the lower die when the roughly forged gear teeth are set in the die cavity. The secondary forged article is a gear having sized gear teeth and a hollow shaft extending from a center of the gear, the hollow shaft having an inside diameter substantially equal to an outside diameter of the punch. The sizing process and an axial hole forming process (that forms an axial hole of the hollow shaft) can be performed continuously at a single processing step and, hence, the secondary forged article can be produced with reduced cost and enhanced productivity.

Preferably, the gear of the primary forged article is a bevel gear, and the roughly forged part is bevel gear teeth. The other of the upper die and the lower die has a sizing section forming a part of the peripheral surface of the die cavity.

According to a second aspect of the present invention, there is provided an apparatus for sizing a roughly forged part of a primary forged article to produce a secondary forged article having a sized part of desired dimensional accuracy, the apparatus comprising: an upper die and a lower die relatively movable toward and away from each other and jointly defining a die cavity complementary in shape to the sized part of the secondary forged article to be produced, one of the upper die and the lower die having a vertical through-hole formed therein in direct communication with the die cavity; and a punch relatively movably received in the vertical through-hole formed in said one of the upper die and the lower die, the punch having an outside diameter smaller than an inside diameter of the vertical through-hole, there being an annular material flow passage defined between an inner peripheral surface of the vertical through-hole and an outer peripheral surface of the punch, the annular material flow passage allowing excess material generated during sizing of the roughly forged part within the die cavity to flow into the annular material flow passage.

With this arrangement, the apparatus is able to continuously perform a sizing process on the roughly forged part of the primary forged article and an axial hole forming process on a shaft part of the primary forged article only by providing the vertical through-hole in the one of the upper die and the lower die and the punch relatively movably received in the vertical through-hole so as to define jointly with the vertical through-hole the annular material flow passage. The apparatus is relatively simple in construction and can be manufactured at a reduced cost.

Preferably, the apparatus further comprises an urging mechanism that urges said one of the upper die and the lower die toward the other of the upper die and the lower die so as to ensure that the upper die and the lower die which have been brought together can be moved in a vertical direction relative to the punch to thereby cause the punch to advance toward the die cavity.

In one preferred form of the invention, the primary forged article is a gear having roughly forged gear teeth and a shaft extending from a center of the gear, and the vertical through-hole has an inside diameter snugly receptive of the shaft of the primary forged article. This arrangement ensures that the sizing process and the axial hole forming process can be performed stably and reliably.

Preferably, the gear of the primary forged article is a bevel gear and the roughly forged part is bevel gear teeth, wherein the other of the upper die and the lower die has a sizing section forming a part of the peripheral surface of the die cavity.

BRIEF DESCRIPTION OF THE DRAWINGS

A certain preferred structural embodiment of the present invention will be described in detail below, by way of example only, with reference to the accompanying sheets of drawings.

DESCRIPTION OF PREFERRED EMBODIMENTS

Figure 1A:
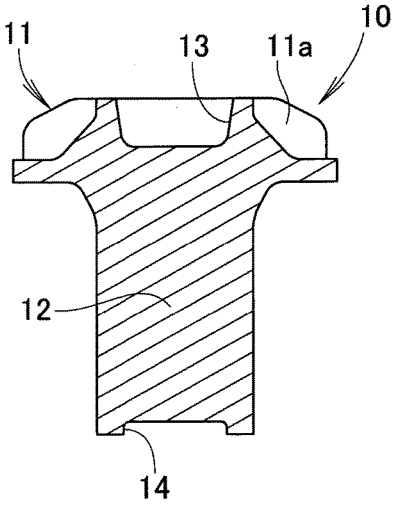
FIG. 1A is a cross-sectional view of a primary forged article before being subjected to a sizing process according to the present invention.

Referring now to the drawings and FIG. 1A in particular, there is shown a primary forged article 10 to be subjected to a sizing process according to the present invention. The primary forged article 10 is in the form of a blank bevel gear 11 having a shaft 12 extending from a center of the blank bevel gear 11. The blank bevel gear 11 has a roughly forged part (gear teeth) 11*a*, and the shaft 12 is a solid shaft. The primary forged article 10 has an upper circular recess 13 formed on an upper surface of the blank bevel gear 11, and a lower circular recess 14 formed on a bottom surface of the shaft 12. The upper and lower circular recesses 13, 14 are coaxial with each other and they are aligned with a common axis of the blank bevel gear 11 and the shaft 12. The upper circular recess 13 has a peripheral wall located near the roughly forged part (gear teeth) 11*a* of the blank bevel gear 11.

The primary forged article 10 can be easily mass produced by forging a heated metal stock. In the hot-forging process, the metal stock is subjected to a plastic working while the metal stock is still hot and soft. The productivity of the hot-forging process is relatively high and, hence, the production cost can be reduced. However, due to a large temperature difference between a working temperature (high temperature) and a post-working temperature (room temperature), the effect of temperature variations is hard to predict. With this difficulty, the dimensional accuracy of the roughly forged part 11*a* of the primary forced article 10 is relatively low.

Figure 1B:
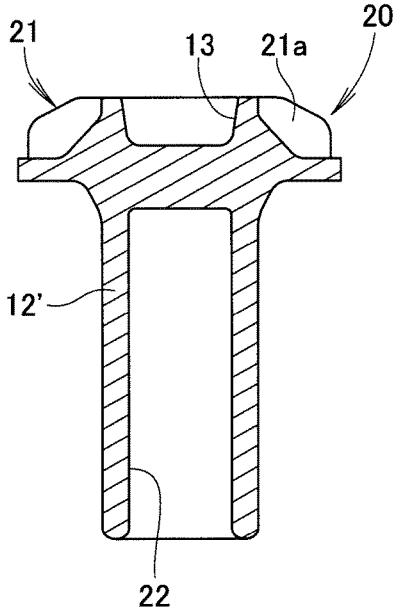
FIG. 1B is a cross-sectional view of a secondary forged article after obtained through the sizing process of the present invention.

The primary forged article 10 is therefore subjected to a sizing process in order to produce a secondary forged article 20 shown in FIG. 1B. The secondary forged article 20 is a bevel gear 21 having a long shaft 12' extending from a center of the bevel gear 21. The bevel gear 21 has a sized or finished part (gear teeth) 21*a* of better dimensional accuracy. The shaft 12' is a hollow shaft having an axial hole 22 formed therein. The axial hole 22 has a relatively large diameter.

In the illustrated embodiment, the secondary forged article 20 is a gear having a shaft and, more particularly, a bevel gear having a hollow shaft, and the finished part 21*a* is gear teeth and, more particularly, bevel gear teeth. The secondary forged article 20 is produced by a sizing apparatus 30, which will be described in greater detail below with reference to FIGS. 2 and 3.

Figure 2:
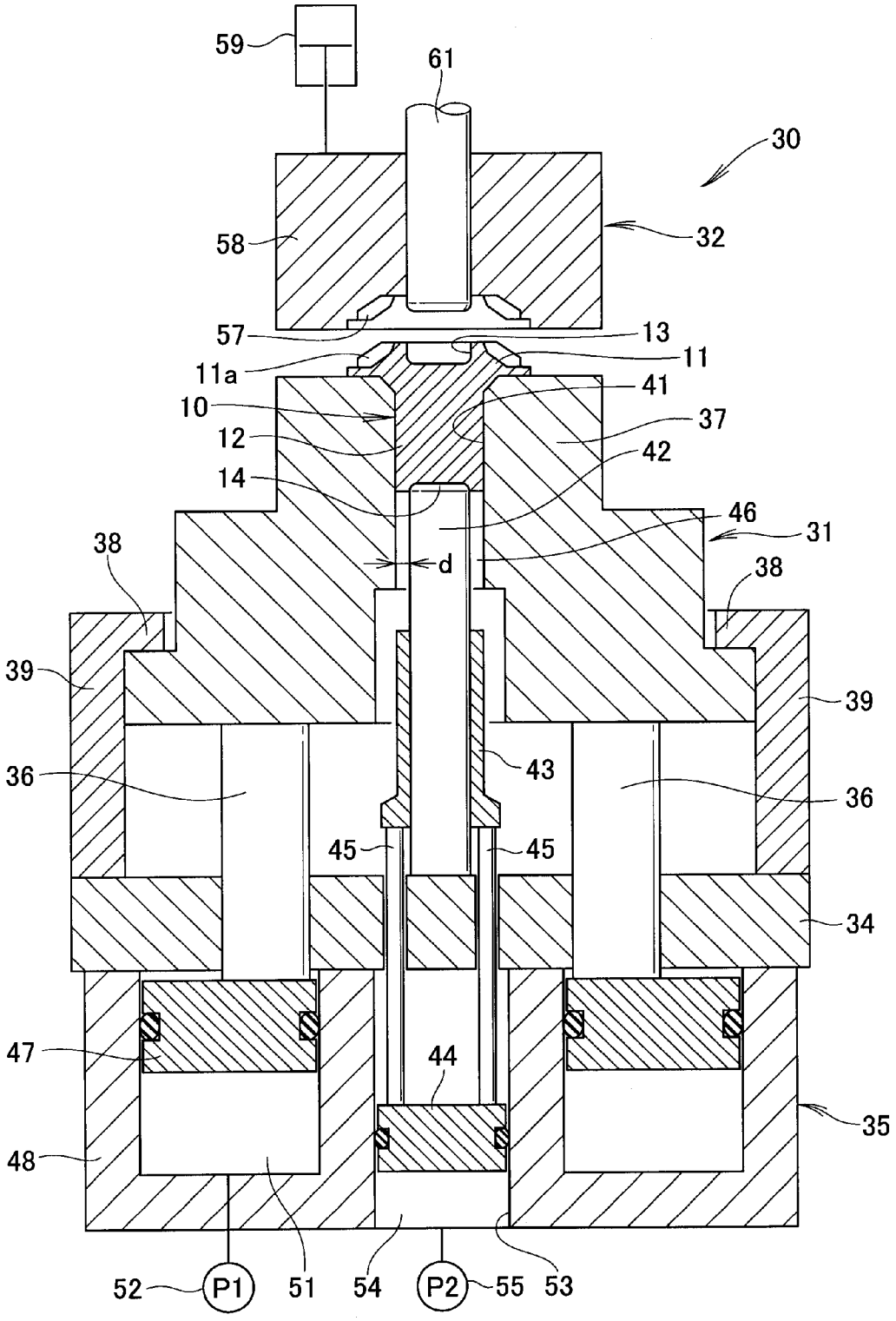
FIG. 2 is a cross-sectional view of a sizing apparatus according to the present invention.

As shown in FIG. 2, the sizing apparatus 30 includes a lower die unit 31 and an upper die unit 32. The lower die unit 31 includes a base 34, an urging mechanism 35 attached to a lower surface of the base 34, a lower die 37 supported by a plurality of piston rods 36 extending upwardly from the urging mechanism 35 through the base 34, a lower die holder 39 disposed on the base 34 and having a stopper 38 for limiting an upper limit position of the lower die 37, a punch 42 extending upwardly from the base 34 in such a manner as to be received concentrically in a vertical through-hole 41 formed in the lower die 37, a knockout ring 43 fitted over the punch 42 and vertically movable relative to the punch 42, a second piston 44 provided below the base 34 to undergo vertical reciprocating movement, and a plurality of knockout pins 45 extending upwardly from the second piston 44 through the base 34 and supporting the knockout ring 43.

The punch 42 has an outside diameter smaller than an inside diameter of the through-hole 41 and corresponding to an inside diameter of the axial hole 22 (FIG. 1B). As a result, there is an annular space d formed between an outer peripheral surface of the punch 42 and an inner peripheral surface of the through-hole 41 of the lower die 37. The annular space d forms an annular material flow passage 46 which will allow excess material to flow into the material flow passage 46 during the sizing process.

The urging mechanism 35 includes a ring-shaped first piston 47 supporting the piston rods 36, a cylinder case 48 fixedly connected to the base 34 and slidably receiving therein the first piston 47 for vertical reciprocating movement of the first piston 47, and a first pressure source 52 for supplying a pressure medium at a prescribed pressure to a first pressure chamber 51 defined below the first piston 47 within the cylinder case 48. The first pressure source 52 is preferably an oil-hydraulic pressure.

The second piston 44 is slidably received in a second cylinder 53 formed integrally with the cylinder case 48 at a central part of the cylinder case 48. A second pressure source 55 is provided for supplying a pressure medium at a prescribed pressure to a second pressure chamber 54 defined below the second piston 44 within the second cylinder 53.

The upper die unit 32 includes an upper die 58 having a sizing section 57, and an ascending/descending mechanism 59 for ascending and descending the upper die 58, and a center pin 61 provided at a center of the upper die 58. The sizing section 57 forms a part of a peripheral surface of a die cavity 60 (FIG. 3) defined when the upper die 58 and the lower die 37 are closed.

Operation of the sizing apparatus 30 of the foregoing construction will be described below with reference to FIGS. 2-4. As shown in FIG. 2, the primary forged article 10 is set on the lower die 37 such that the blank bevel gear 11 is supported on an upper surface of the lower die 37, the shaft 12 is fitted in the vertical through-hole 41, and an upper end of the punch 42 is fitted in the lower circular recess 14. The first pressure chamber 51 is filled with the pressure medium of the prescribed pressure so that the lower die 37 is urged upward until it arrives at an upper limit position defined by the stopper 38 of the lower die holder 39. While keeping this condition, the ascending/descending mechanism 59 is operated to lower the upper die 58 and the center pin 61 in unison with each other. With this descending movement of the upper die 58, sizing or finishing of the roughly forged part 11*a* of the blank bevel gear 11 is commenced by the sizing section 57 of the upper die 58.

In this instance, because the center pin 61 comes into fitting engagement with the upper circular recess 13 of the primary forged article 10 to thereby prevent the primary forged article 10 from displacing in a horizontal direction, the sizing process can be started with enhanced stability. During the sizing process, the upper die 58 comes in contact with the lower die 37 and forces the lower die 37 downward. When the downward pressure or force applied from the upper die 58 to the lower die 37 exceeds an upward bias or urging force of the urging mechanism 35, the lower die 37 begins to descend together with the upper die 58.

Figure 3:
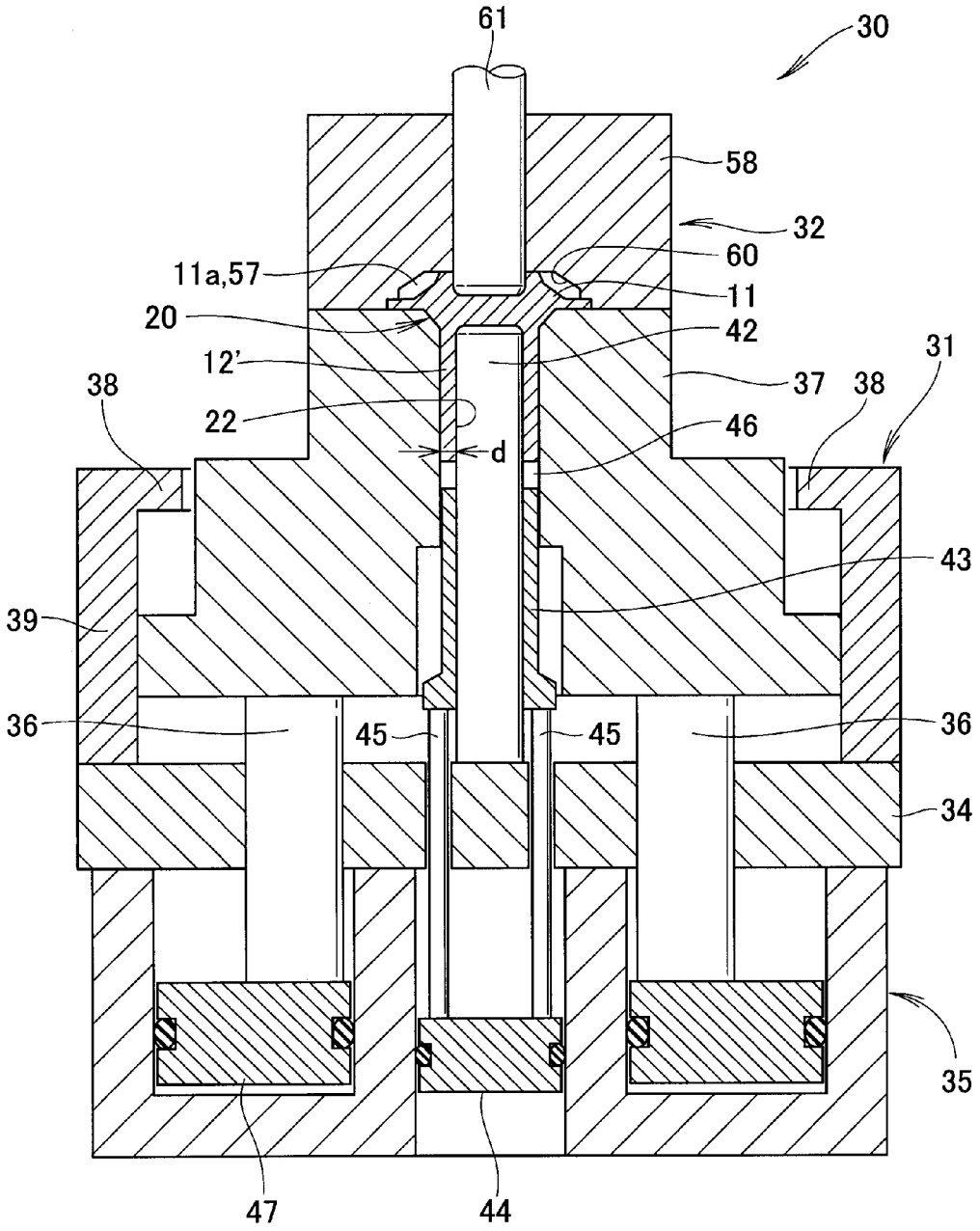
FIG. 3 is a view similar to FIG. 2, but showing an operation of the sizing apparatus.

As shown in FIG. 3, the roughly forged part 11*a* is subjected to the sizing process performed within the die cavity 60 defined between the lower die 37 and the upper die 58. Due to the presence of the annular gap d, an excess material produced during the sizing process is allowed to flow into the material flow passage 46. Furthermore, since the punch 42 remains stationary while the lower die 37 moves downward, the shaft 12 shown in FIG. 2 is formed into a hollow shape. The hollow shaft 12' has an axial hole 22 and a length of the hollow shaft 12' is larger than a length of the shaft 12 of the primary forged article 10 (FIG. 2). The axial hole 22 has an inside diameter substantially equal to the outside diameter of the punch 42.

When the lower die 37 arrives at a prescribed lower limit position shown in FIG. 3, downward movement of the upper die 58 is stopped. The sizing process and the flow of the excess material are terminated. Then, the upper die 58 is moved upward, the lower die 37 moves upward under the effect of the upward bias or urging force of the urging mechanism 35 until the lower die 37 returns to the upper limit position shown in FIG. 2. Subsequently, the knockout pins 45 and the knockout ring 43 are moved upward by the second piston 44 so that a secondary forged article 20 is pushed up from the lower die 37. Thereafter, the secondary forged article 20 is removed from the sizing apparatus 30 by a suitable handing means such as a robot (not shown).

Operation of the material flow passage 46 will be described in greater detail below with reference to FIGS. 4A and 4B. As shown in FIG. 4A, the roughly forged part (gear teeth) 11*a* of the primary forged article 10 is compression formed by the sizing section 57 of the upper die 58. In this instance, excess material generated during the compression forming is allowed to flow into the material flow passage 46 (annular space d). The primary forged article 10, the lower die 37, the upper die 58 and the center pin 61 move together in a downward direction the punch 42 remains stationary.

With this downward movement of the primary forged article 10 relative to the punch 42, two material flows are created: one being a flow of material directed toward the peripheral surface of the die cavity which is represented by an inner surface of the sizing section 57, as indicated by the arrow (1); and the other being a flow of material directed toward the material flow passage 46, as indicated by the arrow (2). The thus created branched material flows have an effect to promote the flow of material tending to urge the material to swell more positively toward the peripheral surface of the die cavity 60 (more particularly, toward the inner surface of the sizing section 57). This will insure a level of surface roughness which is remarkably improved as compared to the surface roughness obtained by the conventional sizing process performed exclusively within a closed sizing die.

Figure 4B:
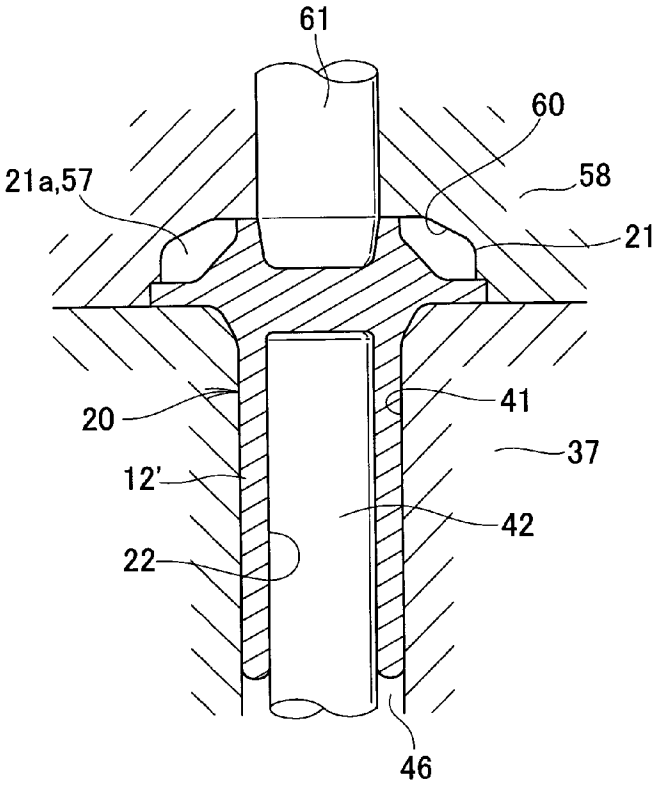
FIGS. 4A and 4B are cross-sectional views illustrative of an operation of a material flow passage formed in the sizing apparatus.
Figure 4A:
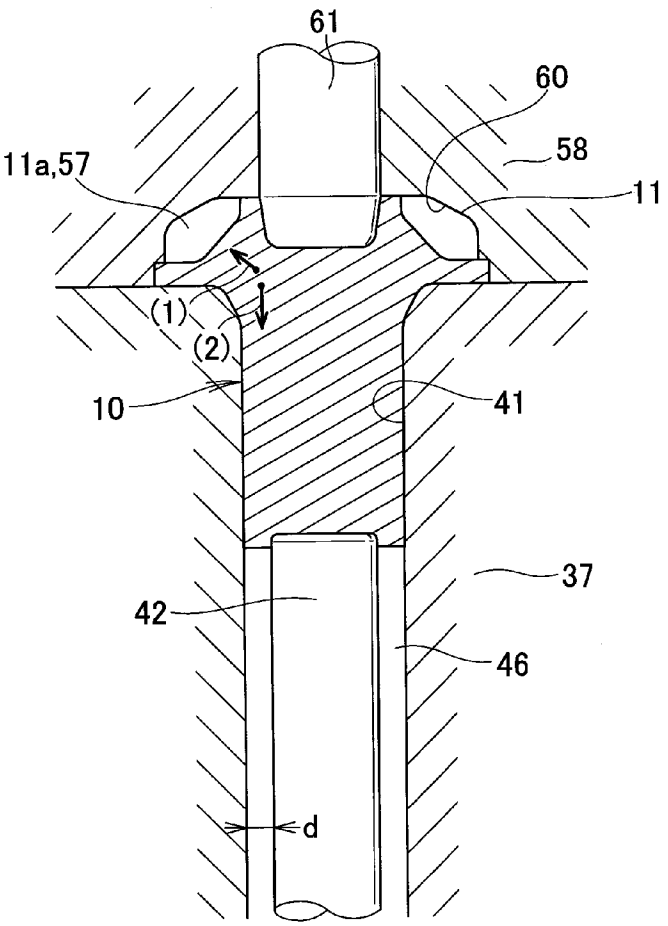

As a result, the excess material flows into the material flow passage 46 (annular space d) and a hollow shaft 12' having an axially hole 22 is eventually formed, as shown in FIG. 4B. Conventionally, the sizing process and the axial hole forming process are performed at separate processing steps with an intermediate processing, such as a phosphate treatment, interposed therebetween. By contrast, according to the present invention, the sizing process and the axial hole forming process are performed continuously as a single processing step. As a result of the flow of excess material into the material flow passage 46 (annular space d), the length of the hollow shaft 12' is larger than the length of the shaft 12. The secondary forged article 20 can thus be provided with an elongated shaft 12'.

The foregoing sizing process or method can be summarized as follows. As shown in FIG. 2, an upper die 58 and a lower die 37 relatively movable toward and away from each other and jointly defining a die cavity 60 are provided. The die cavity 60 is complementary or corresponding in shape to a sized part 21*a* of a secondary forged article 20 to be produced. One of the upper die 58 and the lower die 37 has a vertical through-hole 41 formed therein in direct communication with the die cavity 60, and a punch is relatively movably received in the vertical through-hole in such a manner as to define, jointly with the vertical through-hole, an annular material flow passage. Then, a roughly forged part 11*a* of a primary forged article 10 is set in the die cavity 60 while the upper and lower dies 58, 37 are opened. Subsequently, as shown in FIG. 3, the upper die and the lower die are brought together to thereby perform a sizing work on the roughly forged part 11*a* of the primary forged article 10 within the die cavity 60 and, while keeping a closed state of the upper and lower dies 58, 37, the upper and lower dies 58, 37 and the punch 42 are moved relatively to each other in a vertical direction to advance the punch 42 toward the die cavity 60 to thereby force a material of the roughly forged part 10*a* against a peripheral surface of the die cavity 60 while allowing an excess material of the roughly forged part 11*a* to flow into the annular material flow passage, thereby producing a secondary forged article 20 having a sized part 21*a* of desired dimensional accuracy.

It can be readily appreciated from the foregoing description that the present invention is particularly suitable for use in the production of a bevel gear having a hollow shaft. However, the invention should by no means be limited to the illustrated embodiment but may be effectively applied to the production of general gears or mechanical components having a roughly forged part.

Although in the illustrated embodiment, the primary forged article is a hot-forged article (i.e., an article formed by hot-forging), a warm-formed article (i.e., an article formed by warm-forging) or a cold-formed article (i.e., an article formed by cold-forging) can be used as a blank to be sized by the present invention. The secondary forged article is preferably a cold-formed article or a warm-formed article. It is recommended that the primary forged article is a hot-forged article from the viewpoint of improving the productivity, and the secondary forged article is a cold-formed article from the viewpoint of dimensional accuracy.

Furthermore, the axial hole 22 may be formed by using the center pin 61 in place of the punch 42. As an alternative, the center pin 61 and the punch 42 may be arranged to cooperate in forming the axial hole 22. In these cases, the center pin 61 is arranged to move in a vertical direction independently from the upper die 58.

Obviously, various minor changes and modifications of the present invention are possible in the light of the above teaching. It is therefore to be understood that within the scope of the appended claims the invention may be practiced otherwise than as specifically described.

What is claimed is:

1. A method of sizing a roughly forged part of a primary forged article to produce a secondary forged article having a sized part of desired dimensional accuracy, the method comprising the steps of:

providing an upper die and a lower die relatively movable toward and away from each other and jointly defining a die cavity complementary in shape to the sized part of the secondary forged article to be produced, and a punch relatively movably received in a vertical through-hole formed in one of the upper die and the lower die in direct communication with the die cavity such that an annular material flow passage is defined between the vertical through-hole and the punch, the annular material flow passage extends away from the die cavity in a vertical direction;

setting the roughly forged part of the primary forged article in the die cavity while the upper and lower dies are opened, the roughly forged part of the primary forged article being set in the die cavity so that the annular material flow passage is entirely free of any portion of the primary forged article; and bringing together the upper die and the lower die to thereby perform a sizing work on the roughly forged part of the primary forged article within the die cavity and, while keeping a closed state of the upper and lower dies and with the roughly forged part of the primary forged article being set in the die cavity with the annular material flow passage entirely free of any portion of the primary forged article, moving the upper and lower dies and the punch relatively to each other in the vertical direction to advance the punch toward the die cavity to thereby force a material of the roughly forged part against a peripheral surface of the die cavity while forcing an excess material of the primary forged article to flow into the annular material flow passage in the vertical direction away from the die cavity, thereby producing the secondary forged article with a height greater than that of the primary forged article in the vertical direction.

2. The method according to claim 1, wherein the primary forged article is a gear having roughly forged gear teeth and a solid shaft extending from a center of the gear, the solid shaft of the primary forged article being received in the vertical through-hole of said one of the upper die and the lower die when the roughly forged gear teeth are set in the die cavity during setting the roughly forged part of the primary forged article in the die cavity while the upper and lower dies are opened, and the secondary forged article is a gear having sized gear teeth and a hollow shaft extending from a center of the gear, the hollow shaft being formed by the punch advancing toward the die cavity and thereby forming an axial hole in the solid shaft of the primary forged article within an annular portion thereof between the vertical through-hole and the punch and the annular portion having an inside diameter substantially equal to an outside diameter of the punch.

3. The method according to claim 2, wherein the gear of the primary forged article is a bevel gear, and the roughly forged part is bevel gear teeth, and wherein the other of the upper die and the lower die has a sizing section forming a part of the peripheral surface of the die cavity.

4. An apparatus for sizing a roughly forged part of a primary forged article to produce a secondary forged article having a sized part of desired dimensional accuracy, the apparatus comprising:

an upper die and a lower die relatively movable toward and away from each other and jointly defining a die cavity complementary in shape to the sized part of the secondary forged article to be produced, one of the upper die and the lower die having a vertical through-hole formed therein in direct communication with the die cavity; and a punch relatively movably received in the vertical through-hole formed in said one of the upper die and the lower die, the punch having an outside diameter smaller than an inside diameter of the vertical through-hole, there being an annular material flow passage defined between an inner peripheral surface of the vertical through-hole and an outer peripheral surface of the punch, the annular material flow passage allowing excess material generated during sizing of the roughly forged part within the die cavity to flow into the annular material flow passage, wherein the annular material flow passage extends away from the die cavity in a direction of movement of the punch and is configured to allow the excess material generated during sizing of the roughly forged part within the die cavity to flow away from the die cavity to thereby produce the secondary forged article with a height greater than that of the primary forged article.

5. The apparatus according to claim 4, further comprising an urging mechanism that urges said one of the upper die and the lower die toward the other of the upper die and the lower die so as to ensure that the upper die and the lower die which have been brought together can be moved in a vertical direction relative to the punch to thereby cause the punch to advance toward the die cavity.

6. The apparatus according to claim 4, wherein the primary forged article is a gear having roughly forged gear teeth and a shaft extending from a center of the gear, and the vertical through-hole has an inside diameter snugly receptive of the shaft of the primary forged article.

7. The apparatus according to claim 6, wherein the gear of the primary forged article is a bevel gear and the roughly forged part is bevel gear teeth, and wherein the other of the upper die and the lower die has a sizing section forming a part of the peripheral surface of the die cavity.

* * * * *